US005666753A

United States Patent [19]

Kolling

[11] Patent Number: 5,666,753

[45] Date of Patent: Sep. 16, 1997

[54] SAFETY SWITCH FOR SHOTGUN EQUIPPED WITH SCOPE

[75] Inventor: Robert G. Kolling, Rochester, Minn.

[73] Assignee: Rochester Gunsmiths, Inc., Rochester, Minn.

[21] Appl. No.: 490,133

[22] Filed: Jun. 14, 1995

[51] Int. Cl.[6] ..... F41A 17/00

[52] U.S. Cl. ..... 42/70.01; 42/70.08; 89/27.12

[58] Field of Search ..... 42/70.01, 70.04, 42/70.05, 70.08, 70.06; 89/27.12

[56] References Cited

U.S. PATENT DOCUMENTS

| | | | |
|---|---|---|---|
| 639,421 | 12/1899 | Mauser | 42/70 |
| 893,866 | 7/1908 | Parry | 42/70 |
| 2,484,977 | 10/1949 | Wilcox | 42/70 |
| 2,648,926 | 8/1953 | Ackerson | 42/70 |
| 2,790,261 | 4/1957 | Wood | 42/70 |
| 3,006,096 | 10/1961 | Green et al. | 42/70.01 |
| 3,259,986 | 7/1966 | Carr | 33/50 |
| 4,601,123 | 7/1986 | Swearengen et al. | 42/72 |

OTHER PUBLICATIONS

*Shooting Times*, Jun. 1989, pp. 36–37.

*Primary Examiner*—J. Woodrow Eldred

*Attorney, Agent, or Firm*—Nawrocki, Rooney & Sivertson

[57] ABSTRACT

An improved safety switch for a shotgun including a base portion for a slidable connection to the body of the shotgun. The switch having an exposed portion with a transverse extension accessible from one side of the shotgun.

9 Claims, 3 Drawing Sheets

SAFETY SWITCH FOR SHOTGUN EQUIPPED WITH SCOPE

BACKGROUND OF THE INVENTION

The present invention relates to a safety for a shotgun. More particularly, the present invention relates to an improved safety for use with a shotgun having a scope.

Safety mechanisms are used to enable or to disable the firing mechanism of a firing arm. This allows the user to disable the firearm when it is not in use to prevent unintentional firing. Prior art safety mechanisms designed for shotguns have included a switch which moves longitudinally with respect to the length of the barrel. Such prior art systems for shotguns, however, are not configured to accommodate a scope.

Shotguns are primarily used for applications such as hunting fowl which do not require the use of scopes. Shotguns are designed, however, to accommodate the firing of "slugs" for hunting larger animals, such as deer. The use of shotguns firing "slugs" is preferred over rifles when hunting animals in populated areas because "slugs" have a shorter trajectory or range than bullets fired from a rifle. These "slug" applications benefit from the use of scopes because they reduce the possibility of striking unintended targets.

The placement of a scope when mounted on a shotgun interferes with easy interaction with the safety switch. Typically the safety switch and scope are both located on top of the shotgun such that the safety switch is positioned directly beneath the scope where the scope is secured to the top of the body of the shotgun. Shotguns are typically designed such that when the index finger engages the trigger, the thumb of the same hand can easily reach and slidably engage the safety switch. The scope is mounted with a slight offset above the body of the shotgun but the typically close proximity of the scope to the body is too small to allow easy engagement of the safety switch with the thumb. The use of gloves in reduced temperature environments introduces additional problems. The typically small profile of prior art safety switches restricts the ease of access when the scope is in place. This restriction results in additional difficulty in positively engaging or disengaging the safety switch which can effect safety and convenience of use.

The safety mechanism in U.S. Pat. No. 2,648,926 to Ackerson is for use with a bolt action rifle. Here, the safety switch swings in a horizontal, rather than vertical plane, beneath a scope mounted above the bolt sleeve and caulking piece. This allows the rear end of the scope to be disposed to the eye of the marksman and mounted at a relatively low level without the scope impairing the operation of the safety switch.

The safety mechanism shown in U.S. Pat. No. 2,484,977 to Wilcox is for rifles with bolt actions and discloses a safety switch rotatable in a horizontal plane rather than a vertical plane. This configuration also allows the rifle to accommodate a scope.

The safety mechanism shown in U.S. Pat. No. 2,790,261 to Wood shows a safety switch which is rotatable in a vertical plane generally about the longitudinal axis of the barrel. None of these prior art safety switches are adapted for use with conventional shot gun safety mechanisms.

SUMMARY OF THE INVENTION

The present invention provides an improved safety switch for shotguns equipped with a scope. The safety switch replaces the standard or factory safety switch, and is adapted for a slidable connection to the top of the body of the shotgun. The standard shotgun safety mechanism is well known in the art and need not be altered to accommodate the safety switch. The safety switch is easily connected to the standard safety mechanism by means well known in the art.

The safety switch has a transverse extension accessible from one side of the shotgun. The transverse extension overcomes the switch engagement difficulty of prior art safety switches by allowing easy engagement of the safety switch when the scope is in place. When the index finger engages the trigger, the thumb of the same hand can reach and slidably engage the safety switch. The scope when mounted on the top of body does not hinder access to the safety switch as the transverse extension allows easy engagement of the safety switch with the thumb.

BRIEF DESCRIPTION OF THE DRAWINGS

In the drawings, like reference numerals indicate corresponding parts or elements of the present invention throughout the several views.

DETAILED DESCRIPTION OF THE INVENTION

Figure 1:
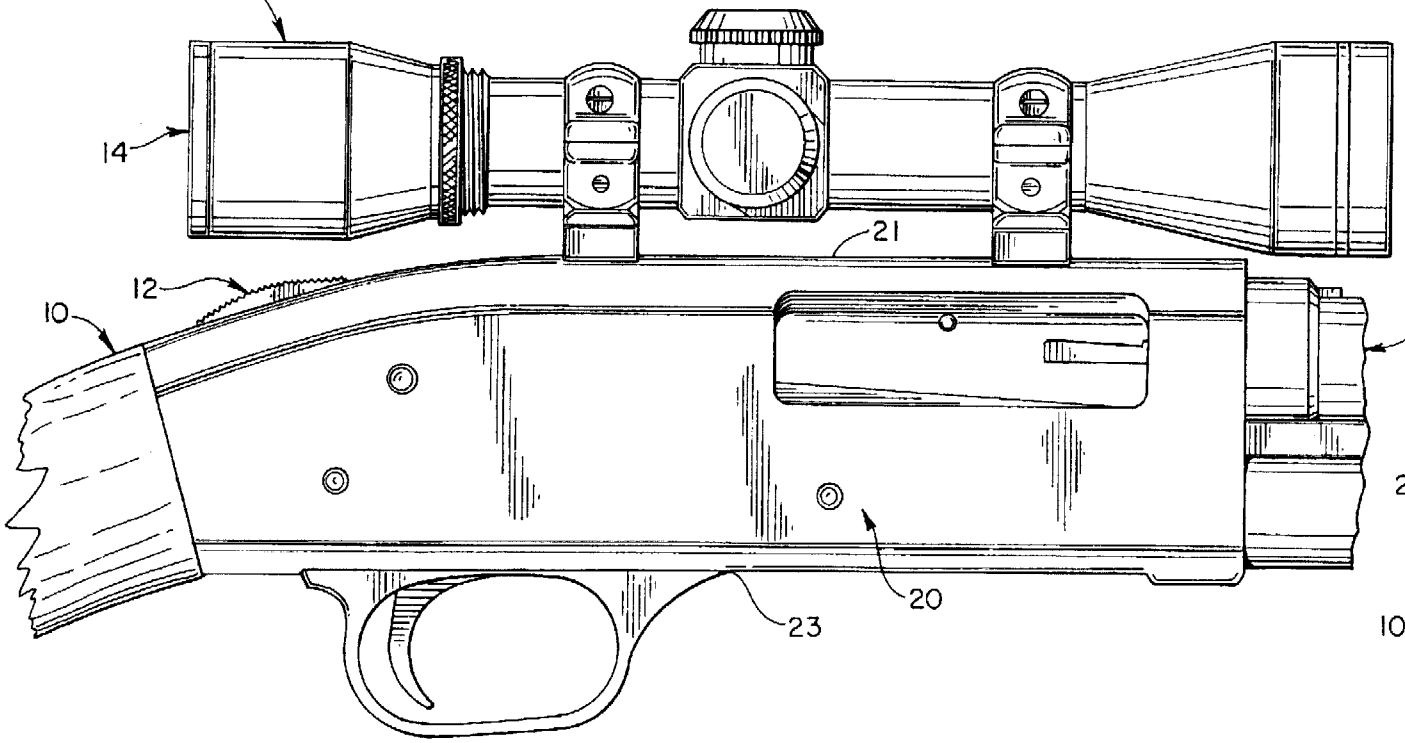
Fig.1 PRIOR ART
FIG. 1 is a side elevational view of a prior art safety switch showing the location of the switch on the shotgun in proximity to the location of the scope.

Referring now to FIG. 1, a side elevational view of a prior art switch 12, this shows the location of the safety switch on the shotgun in proximity to the location of the scope. In FIG. 1, the stock of the shotgun is indicated generally by 10, the barrel of the shotgun is indicated generally by 18, and the body of the shotgun is indicated generally by 20, where the top of body 20 is indicated by 21, and the bottom of body 20 is indicated by 23. The scope sight, represented by 16, is attached and centered longitudinally to the top of body 21. The scope sight is viewed through lens surface 14. Switch 12 is slidably mounted and disposed directly underneath scope sight 16 and is attached to top 21 of body 20.

In use, switch 12 is slidably moved longitudinally between one of two positions to engage and disengage the safety mechanism; one position is towards the forwardly disposed barrel 18, the other position towards the rearwardly disposed stock 10. Scope 16 hinders access to switch 12 thus making it difficult to slidably move switch 12 to either of the two positions.

Figure 2:
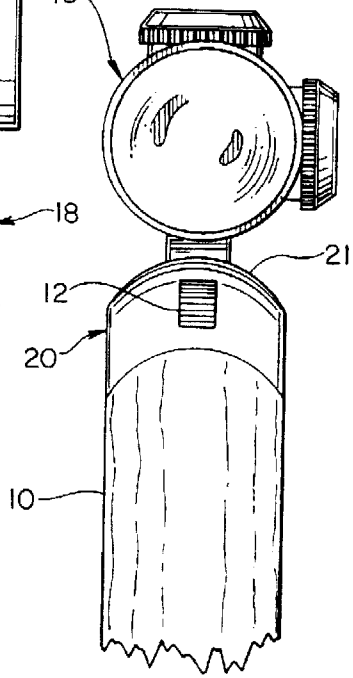
Fig.2 PRIOR ART
FIG. 2 is a rear elevational view of the prior art safety switch of FIG. 1 showing the location of the safety switch in proximity to the scope.

FIG. 2 shows a rear elevational view of the prior art switch 12 showing the close proximity of the location of switch 12 directly beneath the scope 16. The close proximity of scope 16 to switch 12 hinders access to switch 12 thus making it difficult to slidably move switch 12 to either of the two positions.

Figure 3:
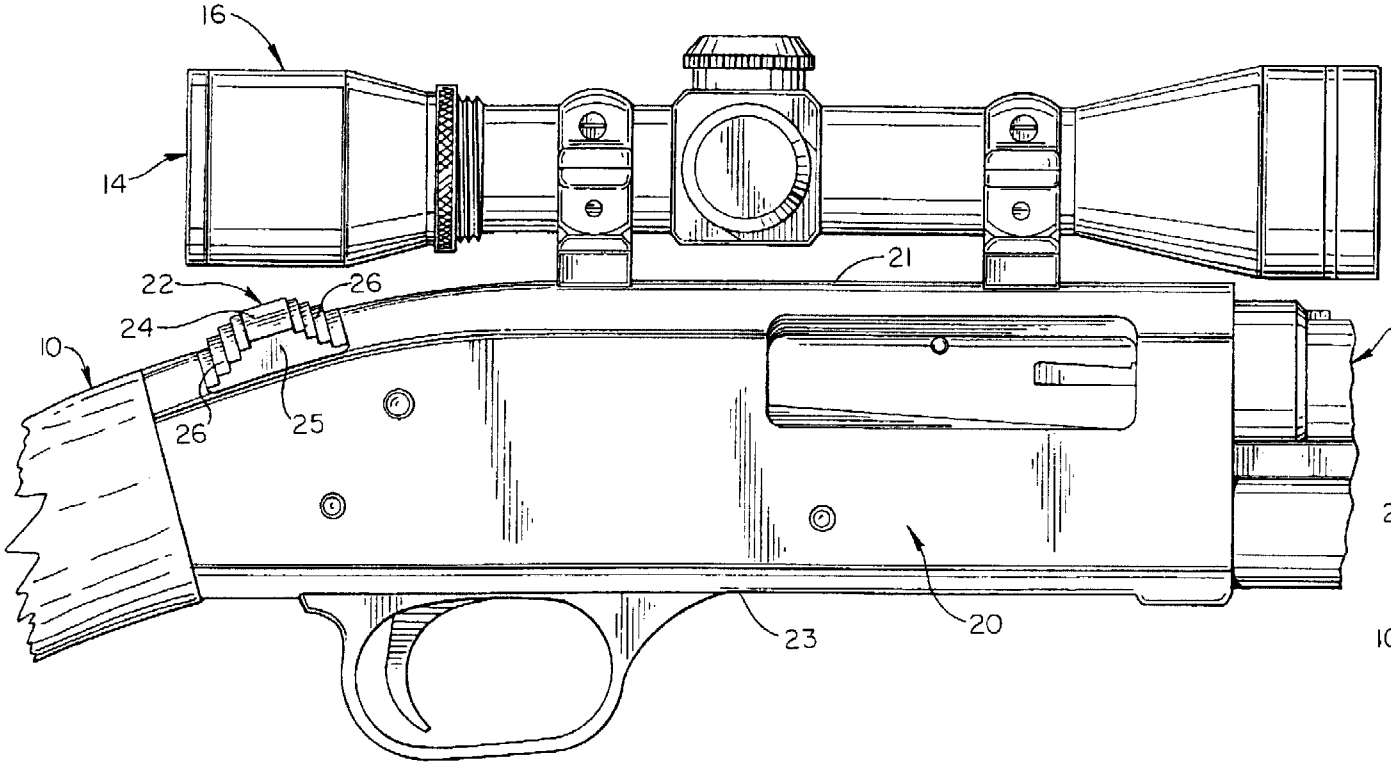
FIG. 3 is a side elevational view of a preferred embodiment of the present invention showing the location of the safety switch on the shotgun and the location in proximity to the scope in accordance with the present invention.

FIG. 3 shows a side elevational view of the preferred embodiment of the present invention showing the location of the safety switch 22 on the shotgun in proximity to the location of the scope. Referring to FIG. 3, the elements are as denoted in FIG. 2, except a safety switch 22 is slidably mounted to the top 21 of body 20 at the same location as the prior art safety switch 12. Safety switch 22 can replace safety switch 12 of shotguns having a top mounted safety switch, such as the Mossberg shotgun models 500, 835, 9200 and 5500.

Safety switch 22 includes exposed portion 25 having a transverse extension 24 accessible from one side of the shotgun for normal use. Safety switch 22 also has a raised portion with ridges 26 to provide for easy gripping. In addition safety switch 22 is contoured to correspond with the surface area of body 20. The standard shotgun safety mechanism is not shown as it is well known in the art, and need not be altered to accommodate safety switch 22. Safety switch 22 is connected to the standard safety mechanism by means well known in the art.

To engage and disengage the safety mechanisms, safety switch 22 is moved slidably and longitudinally between one of two positions; one position is towards the forwardly disposed barrel 18, the other position towards the rearwardly disposed stock 10. When the index finger engages the trigger, the thumb of the same hand can reach and slidably engage the safety switch 22. Scope 16 does not hinder access to safety switch 22 as safety switch 22 includes the transverse extension 24 which provides easy access. Thus the contour of safety switch 22 along with transverse extension 24 and raised ridges 26 allow the thumb to easily engage and move safety switch 22 to either of the two positions.

Figure 4:
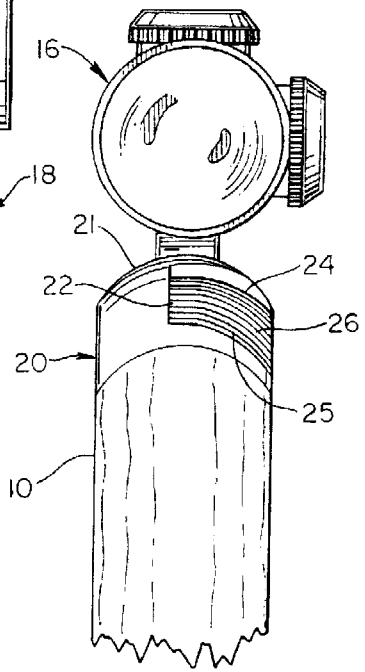
FIG. 4 is a rear elevational view of the preferred embodiment of the present invention showing the location of the safety switch on the shotgun and the location in proximity to the scope in accordance with the present invention.

FIG. 4 shows a rear elevational view of the preferred embodiment of the present invention showing the location of safety switch 22 in proximity to scope 16. FIG. 4 illustrates that safety switch 22 has a transverse extension 24 offset laterally from the longitudinal center of top 21 of body 20 with ridges 26 accessible from one side of the shotgun. This offset allows easy access by the thumb to slidably engage and move the safety switch 22 to either of two positions.

Figure 5:
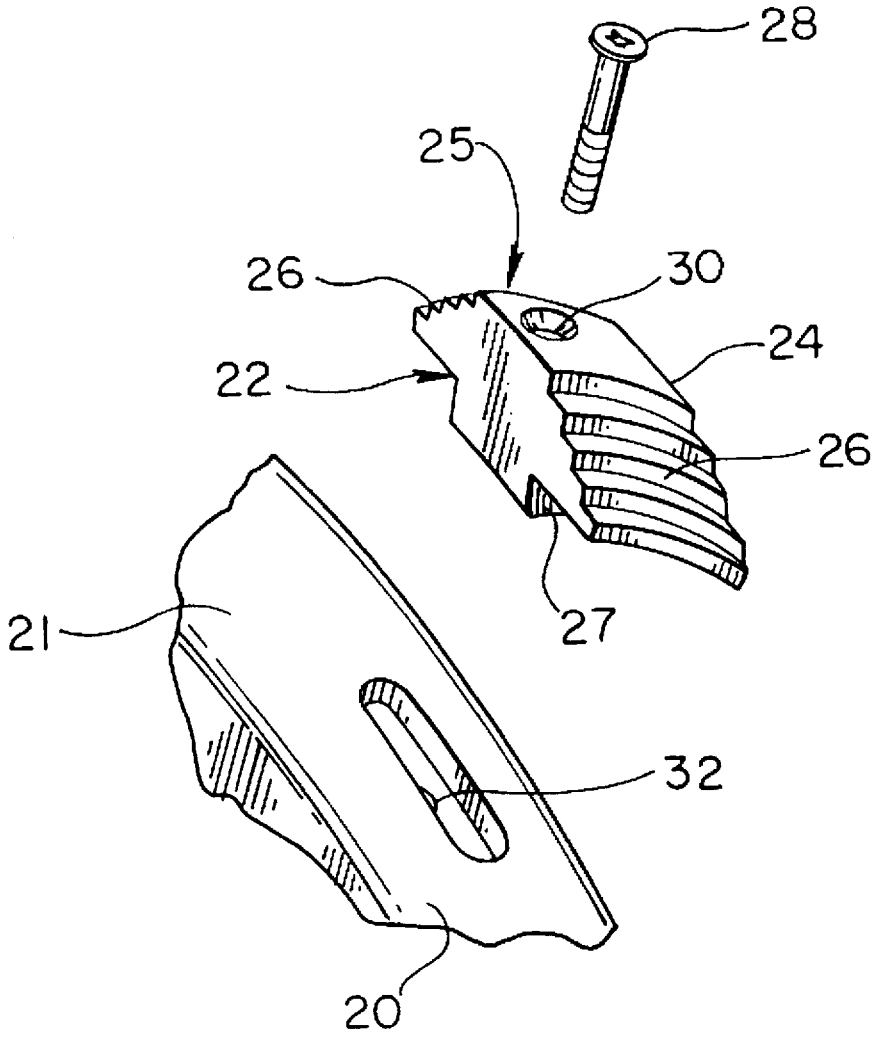
FIG. 5 is a disassembled view of the preferred embodiment of the present invention showing a disassembled view of the safety switch.

FIG. 5 shows a disassembled view of safety switch 22, including a base portion 27. Safety switch 22 is attached to the standard safety mechanism by inserting base portion 27 into body 20 and positioning screw 28 through hole 30 to engage threads 32. The standard shotgun safety mechanism need not be altered to accommodate the safety switch 22. Safety switch 22 replaces prior art switch 12 as shown in FIGS. 1 and 2.

It will be understood that this disclosure is, in many respects, only illustrative. Changes may be made in details, particularly in matters of shape and size, without exceeding the scope of the invention. Accordingly, the scope of the invention is as defined in the language of the appended claims.

What is claimed is:

1. A safety switch for a shotgun, the shotgun having a length, a longitudinally rearwardly disposed stock, a forwardly disposed barrel, and a body positioned between the stock and barrel, the body having a width and a top, the shotgun includes a scope, wherein the scope is attached to the top of the body, the safety switch comprising:

a base portion configured for slidable connection to the body of the shotgun at the top of the body;

an exposed portion extending from the base, the exposed portion including a transverse extension accessible from one side of the shotgun, the extension extending transversely from the top of the shotgun at least one quarter of the width of the body, the switch having a forward end positioned towards the barrel, and a backward end positioned towards the stock, the switch when connected to the body being slidable between a first and a second position, the first position enabling a safety, the second position disabling the safety.

2. A safety switch according to claim 1 where the transverse extension has a raised portion disposed between the forward and backward ends.

3. A safety switch according to claim 2 where the transverse extension has ridges between the forward end and the raised portion and between the backward end and the raised portion, to provide for easy griping.

4. A safety switch according to claim 2 where the transverse extension is contoured to correspond with the surface area of the body.

5. A shotgun, comprising:

a longitudinally rearwardly disposed stock;

a forwardly disposed barrel;

a body positioned between the stock and barrel, and having a top;

a scope attached to the top of the body, the scope having a transverse cross sectional diameter; and a safety switch including an exposed portion extending from a base portion slidably connected to the top of the body adjacent the scope, the exposed portion including a transverse extension accessible from one side of the shotgun, the extension extending transversely from the top of the shotgun at least one quarter the diameter of the scope, the switch having a forward end positioned towards the barrel, and a backward end positioned towards the stock, the switch being slidable between a first and a second position, the first position enabling a safety, the second position disabling the safety.

6. A safety switch according to claim 5 where the transverse extension has a raised portion disposed between the forward and backward ends.

7. A safety switch according to claim 6 where the transverse extension has ridges between the forward end and the raised portion and between the backward end and the raised portion, to provide for easy griping.

8. A safety switch according to claim 6 where the transverse extension is contoured to correspond with the surface area of the shotgun.

9. A method of operating a safety switch for a shotgun including a scope having a transverse cross sectional diameter, the shotgun having a length, a longitudinally rearwardly disposed stock, a forwardly disposed barrel, and a body positioned between the stock and barrel, comprising the steps of:

installing a switch including a base portion configured for slidable connection to the body of the shotgun at the top of the body, the switch including an exposed portion extending from the base, the exposed portion including a transverse extension accessible from one side of the shotgun with a forward end positioned towards the barrel, and a backward end positioned towards the stock, the scope being attached to the body where the transverse extension extends at least one quarter of the diameter of the scope, transversely from the center of the scope, the switch when connected to the body being slidable between a first and a second position, the first position enabling a safety, the second position disabling the safety;

sliding the switch to the first position to enable the shotgun; and sliding the switch to the second position to disable the shotgun.

* * * * *